US007899349B2

(12) United States Patent
Shida

(10) Patent No.: US 7,899,349 B2
(45) Date of Patent: Mar. 1, 2011

(54) IMAGE FORMING APPARATUS WITH CONTROLLER FOR SETTING TRANSFER MEMBER BIAS

(75) Inventor: Masanori Shida, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 269 days.

(21) Appl. No.: 12/186,870

(22) Filed: Aug. 6, 2008

(65) Prior Publication Data

US 2009/0041487 A1 Feb. 12, 2009

(30) Foreign Application Priority Data

Aug. 9, 2007 (JP) ..... 2007-207489

(51) Int. Cl.
*G03G 15/16* (2006.01)

(52) U.S. Cl. ..... 399/66; 399/48

(58) Field of Classification Search ..... 399/44, 399/48, 50, 51, 56, 66
See application file for complete search history.

(56) References Cited

U.S. PATENT DOCUMENTS 3,788,739 A * 1/1974 Coriale ..... 399/48
5,646,717 A 7/1997 Hiroshima et al.
7,072,598 B2 * 7/2006 Takayanagi ..... 399/66
7,088,933 B2 * 8/2006 Kitajima ..... 399/66
2004/0218941 A1 * 11/2004 Katsumi ..... 399/66

FOREIGN PATENT DOCUMENTS

JP 02170175 A * 6/1990
JP 5-6112 A 1/1993
JP 05281860 A * 10/1993
JP 2003-270866 A 9/2003
JP 2006047489 A * 2/2006

* cited by examiner

*Primary Examiner*—Robert Beatty
(74) *Attorney, Agent, or Firm*—Fitzpatrick, Cella, Harper & Scinto

(57) ABSTRACT

In an image forming apparatus, temporary constant voltages are corrected by using three voltage-current data obtained by applying voltages at three levels to a primary transfer roller to detect currents corresponding to the voltages, respectively. A surface potential of a photosensitive drum is detected by a potential sensor by changing an exposure intensity of an exposure device at three levels in a state in which the temporary constant voltage is applied to the primary transfer roller. A constant voltage during image formation is determined by correcting the temporary constant voltage by using three voltage-current data obtained by detecting currents when surfaces different in potential by light exposure pass through a primary transfer portion.

5 Claims, 9 Drawing Sheets

IMAGE FORMING APPARATUS WITH CONTROLLER FOR SETTING TRANSFER MEMBER BIAS

FIELD OF THE INVENTION AND RELATED ART

The present invention relates to an image forming apparatus for transferring a toner image from an image bearing member onto a transfer medium by applying a constant voltage to a transfer member. Specifically, the present invention relates to a constant voltage setting method executed during non-image formation.

Such an image forming apparatus that a toner image formed on an image bearing member is transferred onto a transfer medium (a recording material or an intermediary transfer member) by applying a constant voltage (a constant electric power value) to a transfer member which presses the transfer medium against the image bearing member has been put into practical use.

In an image forming apparatus for performing transfer by applying a constant voltage, a constant voltage value to be applied to the transfer member at the time of transferring the toner image onto the transfer medium is set by measuring a current passing through a transfer portion at each of levels of a stepwise voltage applied to the transfer member during non-image formation (for each pre-rotation, each post-rotation, each output of a predetermined number of sheets, etc.). This is because when a proper constant voltage value is set, it is possible to ensure a current passing through the transfer portion during a transfer operation within a range of a high transfer efficiency.

Japanese Laid-Open Patent Application (JP-A) Hei 05-6112 discloses an image forming apparatus in which a constant voltage value to be applied to a transfer member during image formation is set during non-image formation. In this image forming apparatus, currents are successively detected by applying a stepwisely increasing voltage at a plurality of levels to the transfer member during pre-rotation prior to start of image formation and at the time of detecting a proper current, an applied voltage is determined as a constant voltage value used during image formation.

When the transfer voltage value is determined, a potential on the image bearing member is kept at a constant value so as to be a preset potential. However, the potential of the image bearing member during actual image formation changes to various values. For that reason, the above-determined transfer voltage value is proper with respect to the potential set during the determination but is lowered in accuracy with respect to other potentials. For that reason, it is possible to enhance the accuracy by carrying out a step of stepwisely applying a voltage to the transfer member with respect to a plurality of potentials on the image bearing member but in that case, these arises such a problem that a down time of the image forming apparatus is increased.

On the other hand, during non-image formation, a charge potential or exposure intensity of the image bearing member is stepwisely changed to change a potential of an electrostatic latent image stepwisely, and then a surface potential at each level is measured to set the charge potential or exposure intensity to be applied during toner image formation. For example, as a constitution for setting the exposure intensity, as described in JP-A 2003-270866, it is possible to employ a constitution in which an amount of light of a laser beam during image formation is set in advance of start of the image formation.

It is possible to reduce the down time of the image forming apparatus by a constitution in which a proper transfer voltage value is obtained by applying transfer voltages during a potential measuring step of measuring potentials on the image bearing member. However, when the number of the transfer voltages applied during the potential measuring step is excessively large, there arises a problem that the down time is rather increased. For that reason, a constitution capable of enhancing the accuracy of the toner voltage value without remarkably increasing the time required for the potential measuring step has been desired.

SUMMARY OF THE INVENTION

A principal object of the present invention is to provide an image forming apparatus capable of enhancing setting accuracy of a constant voltage to be applied to a transfer member.

According to an aspect of the present invention is to provide an image forming apparatus comprising:

an image bearing member;

a toner image forming device for forming a toner image on the image bearing member;

a transfer member for forming a transfer portion for transferring the toner image formed on the image bearing member onto a transfer material in a state in which the transfer portion is pressed to the image bearing member;

a power source for applying a voltage to the transfer member;

a current detecting portion for detecting a current passing through the transfer member by the application of the voltage to the transfer member;

a first control portion for executing a first step of setting a first voltage value to be applied to the transfer member depending on an output of the current detecting portion;

a potential detecting member for detecting a potential of the image bearing member;

an adjusting portion for adjusting a toner image forming condition on the basis of an output, from the potential detecting member, of a potential of an electrostatic latent image formed for adjusting the toner image forming condition; and a second control portion for executing a second step of setting a voltage value to be applied to the transfer member during image formation on the basis of a current detected by a current detecting portion when the electrostatic latent image passes through the transfer portion in a state in which the voltage of the first voltage value is applied to the transfer member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

First Embodiment

Figure 1:
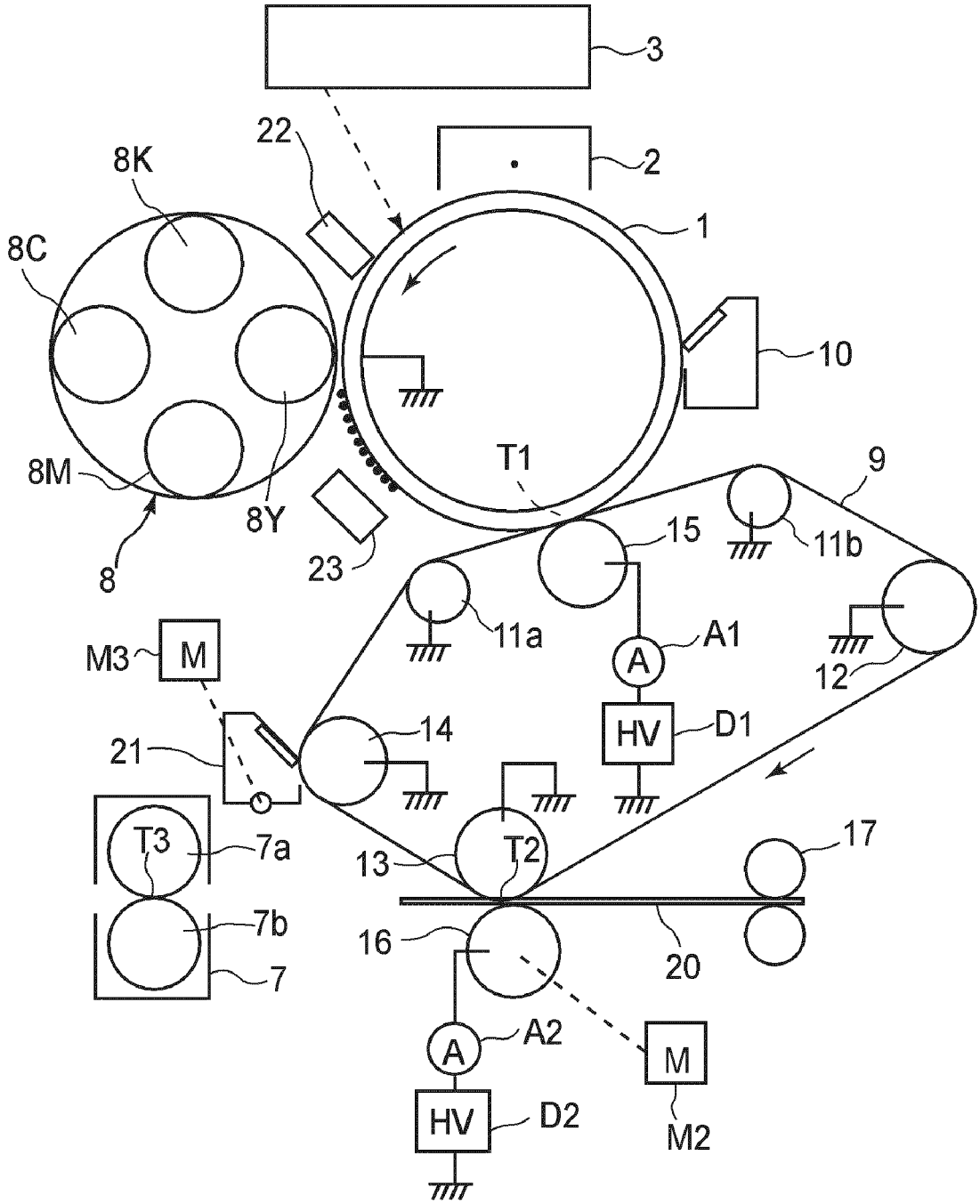
FIG. 1 is a schematic view for illustrating a structure of an image forming apparatus in a First Embodiment.

FIG. 1 is a schematic view for illustrating a structure of an image forming apparatus in the First Embodiment of the present invention. Referring to FIG. 1, an image forming apparatus 100 in this embodiment is a full-color laser beam printer a photosensitive drum 1 as an image bearing member provided with a rotary developing device 8 is brought into contact with an intermediary transfer belt 9 as an intermediary transfer member.

As shown in FIG. 1, the image forming apparatus 100 forms color toner images of yellow, cyan, magenta and black in this order on the photosensitive drum 1 and primary-transfers each of the color toner images onto the intermediary transfer belt 9 at a primary transfer portion T1 for one rotation of the intermediary transfer belt 9. The resultant four color toner images primary-transferred onto the intermediary transfer belt 9 in a superposition manner during four rotations of the intermediary transfer belt 9 are simultaneously secondary-transferred onto a recording material P at a secondary transfer portion T2.

The recording material P on which the four color toner images are secondary-transferred is heat-pressed at a fixing portion T3 of a fixing device 7.

In this embodiment, a toner image forming device includes at least the image bearing member, a charging device 2, an exposure device 3, and the developing device (unit) 8.

The photosensitive drum 1 as an example of the image bearing member is formed in a rotation drum shape by a metal cylinder having an electrophotographic photosensitive layer on its surface and is rotated in a direction of an indicated arrow at a predetermined process speed.

The charging device 2 electrically charges the surface of the photosensitive drum 1 by using a corona discharger. The surface of the rotating photosensitive drum 1 is irradiated with corona discharge ions by the charging device 2, thus being uniformly charged electrically.

The exposure device 3 scans the surface of the charged photosensitive drum 1 with a laser beam to write (form) an electrostatic latent image for an image on the charged surface of the photosensitive drum 1.

The developing device (unit) 8 rotates to position each of a yellow developing device 8Y, a magenta developing device 8M, a cyan developing device 8C and a black developing device 8K in a developing position of the photosensitive drum 1. The developing device 8Y, 8M, 8C and 8K as an example of the developing means employ two-component developers each comprising a mixture of a magnetic carrier and an associated color toner.

When the yellow developing device 8Y moves to the developing position of the photosensitive drum 1, electrically-charged yellow toner is deposited on an electrostatic latent image on the photosensitive drum 1, so that the electrostatic latent image is developed into a yellow toner image.

When the magenta developing device 8M moves to the developing position of the photosensitive drum 1, electrically-charged magenta toner is deposited on an electrostatic latent image on the photosensitive drum 1, so that the electrostatic latent image is developed into a magenta toner image.

When the cyan developing device 8C moves to the developing position of the photosensitive drum 1, electrically-charged cyan toner is deposited on an electrostatic latent image on the photosensitive drum 1, so that the electrostatic latent image is developed into a cyan toner image.

When the black developing device 8K moves to the developing position of the photosensitive drum 1, electrically-charged black toner is deposited on an electrostatic latent image on the photosensitive drum 1, so that the electrostatic latent image is developed into a black toner image.

A cleaning device 10 removes transfer residual toner which passes through the primary transfer portion T1 and remains on the surface of the photosensitive drum 1.

The intermediary transfer belt 9 is supported by a driving roller 14, an inner secondary transfer roller 13, a tension roller 12, the primary transfer roller 15, and stretching rollers 11*a* and 11*b* and circulates in a direction indicated by an arrow. The stretching rollers 11*a* and 11*b* are rotated by the intermediary transfer belt 9 to form a flat primary transfer surface. The driving roller 14 is counted to a main assembly driving mechanism for rotationally driving the photosensitive drum 1 in common with the driving roller 14 and drives the intermediary transfer belt 9 to circulate the intermediary transfer belt 9. The tension roller 12 is urged by a spring to control a tension of the intermediary transfer belt 9 at a constant level.

The intermediary transfer belt 9 is formed, in an endless shape, of a base material including a resin material such as polyimide, polycarbonate, polyester, polypropyrene, polyethylene terephthalate, acrylic resin, polyvinyl chloride, or the like, or various rubber materials, and the like.

In the base material, an appropriate amount of carbon black as an antistatic agent is contained to adjust a volume resistivity of $1\times10^{8}$-$1\times10^{13}$ ohm.cm. A thickness of the intermediary transfer belt 9 is 70-100 μm.

The primary transfer roller 15 as a transfer member presses the intermediary transfer belt 9 against the photosensitive drum 1 to form the primary transfer portion T1 between the photosensitive drum 1 and the intermediary transfer belt 9. The primary transfer roller 15 is an example of a transfer rotatable member for moving the surface of the intermediary transfer belt 9 in the same direction as that of the photosensitive drum 1. A power source D1 as an example of an electric power source applies a DC voltage, of an opposite polarity to a charge polarity of the toner image formed on the photosensitive drum 1, to the primary transfer roller 15 to transfer the toner image formed on the photosensitive drum 1 onto the intermediary transfer belt 9.

An outer secondary transfer roller 16 presses the intermediary transfer belt 9 against the inner secondary transfer roller 13 to form a secondary transfer portion T2 between the intermediary transfer belt 9 and the outer secondary transfer roller 16. A DC voltage of an opposite polarity to the charge polarity of the toner image carried on the intermediary transfer belt 9 to the outer secondary transfer roller 16 to transfer the toner image carried on the intermediary transfer belt 9 onto a recording material P.

The outer secondary transfer roller 16 and a cleaning device 21 are disposed movably toward and away from the intermediary transfer belt 9. The outer secondary transfer roller 16 and the cleaning device 21 are moved away from the intermediary transfer belt 9 in order to avoid contact with the primary-transferred toner image until the toner image prior to the final color toner image is completely primary-transferred onto the intermediary transfer belt 9 during color image formation.

Registration rollers 17 causes the recording material P fed from an unshown recording material accommodating cassette one-by-one to pause and send the recording material P to the secondary transfer portion T2 with timing such that a leading end of the recording material P coincides with the toner image on the intermediary transfer belt 9.

A density sensor 23 detects reflected light by irradiating the toner image formed on the surface of the photosensitive drum 1 with infrared light and outputs an analog voltage corresponding to an amount of toner deposited on the electrostatic latent image.

<Setting of Constant Voltage>

Figure 2:
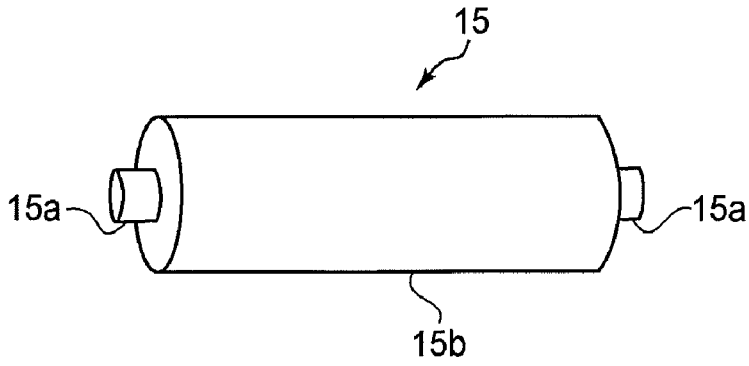
FIG. 2 is a schematic view for illustrating a structure of a primary transfer roller.
Figure 4:
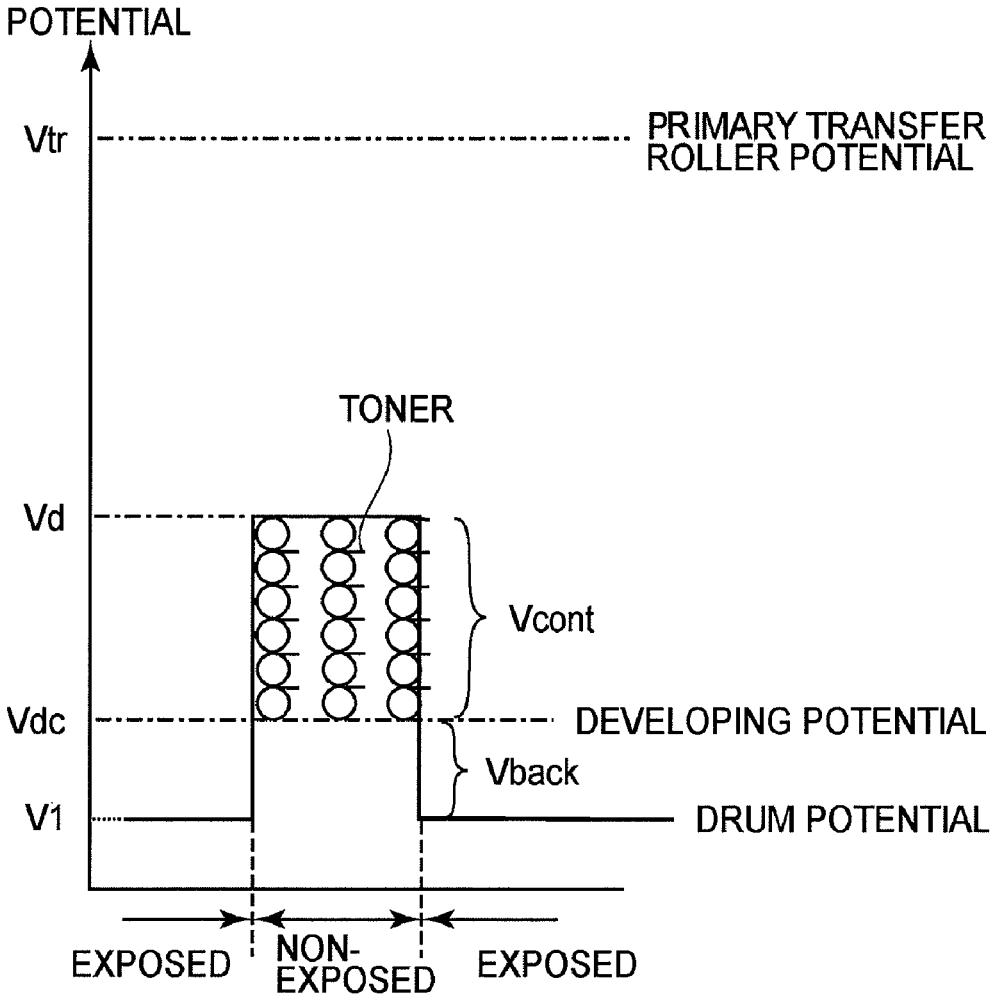
FIG. 4 is a schematic diagram for illustrating regular (normal) development.
Figure 3:
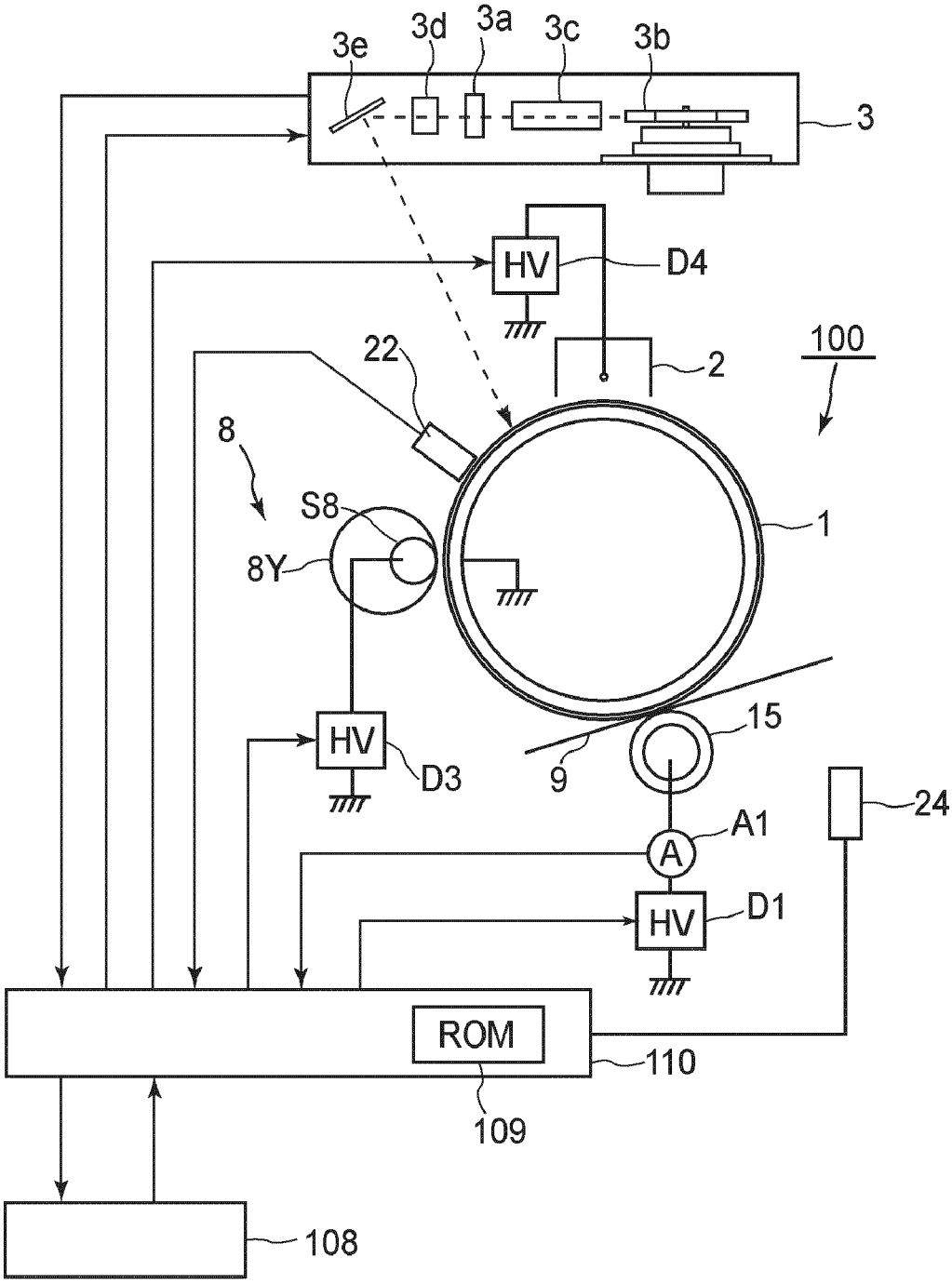
FIG. 3 is a schematic view for specifically illustrating a structure of the image forming apparatus.
Figure 5:
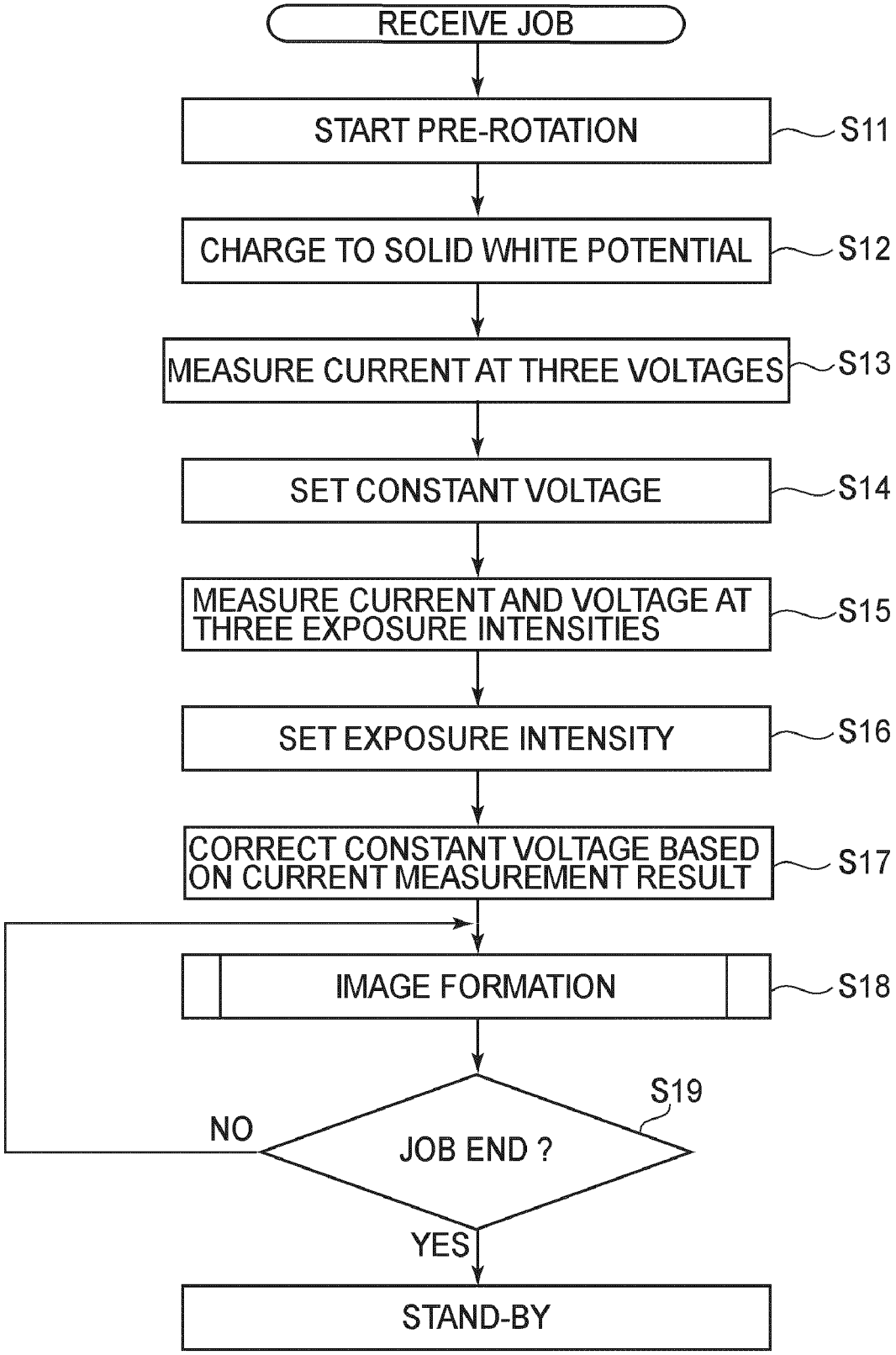
FIG. 5 is a flowchart for illustrating transfer constant voltage setting.

FIG. 2 is an explanatory view of a structure of the primary transfer roller 15, FIG. 3 is a detailed explanatory view of a structure of the image forming apparatus, FIG. 4 is an explanatory diagram of regular (normal) development, and FIG. 5 is a flowchart of transfer constant voltage setting.

As shown in FIG. 2, the primary transfer roller 15 includes an electroconductive core metal 15*a* and an elastic layer 15*b* formed on an outer peripheral surface of the core metal 15*a*. In the elastic layer 15*b*, an ion conductive substance may be dispersed to impart electroconductivity of about $1\times10^{6}$-$1\times10^{10}$ ohm.

The primary transfer roller 15 is classified into two types depending on an imparting manner of the electroconductivity. A primary transfer roller of an electron conductive type contains an electroconductive filler dispersed in an elastic layer and may include an EPDM roller or an urethane roller in which the electroconductive filler, such as carbon black or an metal oxide, is dispersed. On the other hand, a primary transfer roller of an ion conduction type in which an ion conductive substance is contained in an elastic layer. Examples thereof may include a roller formed of an urethane-based material which includes an ion conductivity and a roller having a surfactant-impregnated or dispersed sponge-like elastic layer 15*b*.

The latter primary transfer roller is liable to change in resistance value depending on an ambient temperature, an ambient humidity, or an integrated electric power amount (operating time), so that when a constant voltage to be applied is not changed, it is impossible to supply a proper current to the primary transfer portion T1. As a result, there is a possibility of a lowering in transfer efficiency.

The primary transfer roller 15, as described later, performs primary transfer of a contact transfer type using a constant voltage-controlled voltage. The primary transfer roller 15 supplies an amount of electric charge, necessary to move the toner image from the photosensitive drum 1 to the intermediary transfer belt 9, to the primary transfer portion T1 formed between the photosensitive drum 1 and the intermediary transfer belt 9.

For this reason, when a constant voltage applied to the primary transfer roller 15 is excessively low, a necessary amount of electric charge cannot be sufficiently supplied, so that the toner image to be transferred onto the intermediary transfer belt 9 remains on the photosensitive drum 1 to lower the transfer efficiency. However, when the constant voltage applied to the primary transfer roller 15 is excessively high, the charge polarity is reversed to increase an amount of toner which is transferred back onto the photosensitive drum 1, thus also resulting in the lowering in transfer efficiency.

Therefore, in the First Embodiment, during pre-rotation prior to image formation, currents are detected by applying stepwise voltages of a plurality of levels to the primary transfer roller 15, so that a constant voltage is set on the basis of a detection result. By this, the constant voltage to be applied to the primary transfer roller 15 is set within a very limited range capable of ensuring the toner efficiency at a high level.

A current detecting circuit A1 as a current detecting portion outputs to a control portion 110 an analog voltage corresponding to a current passing through the primary transfer portion T1 by a voltage outputted from the power source D1.

The control portion 110 controls the voltage to be applied to the primary transfer roller 15 by AD-converting the output of the current detecting circuit A1 to detect a current.

The control portion 110 functions as a first control portion. That is, the control portion 110 executes a first step of setting a first voltage value. The first step will now be described. During non-image formation, the control portion 110 controls the power source D1 to apply voltages of a plurality of levels to the primary transfer roller 15 to detect current values at the voltages of the plurality of levels through the current detecting circuit A1. Then, the control portion 110 sets a temporary constant voltage to be applied to the primary transfer roller 15 on the basis of a detection result.

Specifically, an output voltage of the power source D1 is set so that a potential difference between the output voltage of the power source D1 and a light portion potential V1 at a solid white portion of the photosensitive drum 1 is capable of providing a proper current passing through a series resistance consisting of the primary transfer roller 15, the recording material P, and the photosensitive drum 1. As a result, even when the resistance value of the primary transfer roller 15 is increased with accumulation of the ambient temperature or the operating time, the output voltage of the power source D1 can be set so that the proper current can pass through the primary transfer portion T1.

A temperature-humidity sensor 24 detects ambient temperature and humidity in a housing of the image forming apparatus 100 to input the detected values in the control portion 110 as analog voltage signals, respectively.

The control portion 110 effects AD conversion of an output of the temperature/humidity sensor 24 to detect an ambient temperature and an ambient humidity, thus computing an absolute humidity ($g/m^3$).

As shown in FIG. 4 with reference to FIG. 3, in the image forming apparatus 100 in the First Embodiment, the toner image is formed by a regular developing method in which toner is electrically deposited at a non-exposed portion while an exposed portion of the electrostatic latent image is left at a solid white portion.

The photosensitive drum 1 has a surface at which an amorphous silicon photosensitive layer is formed and to which a positive charge polarity is imparted, so that a surface potential is lowered by electric discharge through light exposure after the electric charge. On the other hand, the toner contained in the yellow developing device 8Y of the developing device 8 has a negative charge polarity.

The yellow developing device 8Y disposes the toner, which is negatively charged by mixing with the magnetic carrier and carried on a developing sleeve S8 in a thin layer state, to oppose the photosensitive drum 1 with a slight gap and rotates the developing sleeve in a counter direction.

A power source D3 outputs a developing voltage, in the form of a positive DC voltage Vdc biased with an AC voltage, to the developing sleeve S8. As a result, the toner carried on the developing sleeve S8 is electrically moved to the surface of the photosensitive drum 1 and selectively deposited on the non-exposed portion positively charged compared with the case of only applying the DC voltage Vdc. The negatively-charged toner does not deposit on the exposed portion, negatively charged compared with the case of only applying the DC voltage Vdc, by electrical repulsion.

A difference between the DC voltage Vdc and the light portion potential V1 is called a "fog-removing voltage Vback" and is ensured at a constant value so that the magnetic carrier does not deposit on the photosensitive drum 1 and the toner does not deposit on the exposed portion. The fog-removing voltage Vback is not a problem in many cases even when it is a constant value regardless of an environmental condition, such as the absolute humidity, a temperature or other ambient condition, and the type of the respective color toners.

On the other hand, a difference between the DC voltage Vdc and a dark portion potential Vd is called a "developing contrast Vcont" and is set depending on the type of the recording material P, the ambient humidity or the like in order to reproduce an image density by adjusting the amount of toner deposited on the non-exposed portion.

The electrically-charged yellow toner used in the yellow developing device 8Y is subjected to development on the photosensitive drum 1 at a concentration depending on a charge amount per unit mass (hereinafter referred to as "Q/M") and the developing contrast Vcont. The toner changes in Q/M depending on the environmental condition or the like, so that it is necessary to adjust the developing contrast Vcont depending on the environmental condition in order to subject the same amount of toner to development on the photosensitive drum 1.

That is, it is necessary to set a small developing contrast Vcont in a high humidity environment in which the Q/M of the toner is deceased and set a large developing contrast Vcont in a low humidity environment in which the Q/M of the toner is increased.

Further, even in the same humidity environment, Q/M values of the yellow toner, the magenta toner, the cyan toner, and the black toner are different from each other, so that a proper developing contrast Vcont is required to be set for each of the color toners.

A potential sensor 22 inputs into the control portion 110 an analog voltage output corresponding to the surface potential of the photosensitive drum 1.

The control portion 110 functions as an adjusting portion for adjusting a toner image forming condition depending on an output of the potential detecting member. Specifically, the control portion 110 effects AD conversion of an output of the potential sensor 22 to detect a surface potential and on the basis of a detection result of the surface potential, the control portion 110 controls the power source D4 to electrically charge the surface of the photosensitive drum 1 to a positive dark portion potential Vd.

The exposure device 3 effects scanning exposure of the surface of the photosensitive drum 1 through a mirror 3*e* after scanning of a laser beam emitted from a laser light source 3*a* by rotating mirror 3*b* is performed. An optical system 3*c* forms a beam spot on the photosensitive drum surface by forming an image of a light source image on the photosensitive drum surface. The surface of the photosensitive drum 1 electrically charged to the dark portion potential Vd is electrically discharged by the laser beam irradiation to lower the potential to the light portion potential V1.

The control portion 110 functions as a second control portion for executing a step of setting a voltage value to be applied to the transfer member during image formation by applying a voltage of a first voltage value to the transfer member during a second step of detecting the potential of the image bearing member in order to adjust the toner image forming condition. Specifically, during non-image formation, the control portion 110 controls the exposure device 3, in a state in which the surface of the photosensitive drum 1 is electrically charged to a constant dark portion potential Vd, so that solid white images are formed by exposure with a plurality of different exposure intensities. The control portion 110 continuously and stepwisely changes output states of the charging device 2 and the exposure device 3 so that they are longer than a circumferential length of the primary transfer roller 15 and constant in a state in which a temporary constant voltage is applied to the primary transfer roller 15.

The control portion 110 detects surface potentials at the respective exposure intensities through the potential sensor 22 and on the basis of detection results of the surface potentials, sets a driving voltage of the laser light source 3*a* so that the light portion potential V1 is a predetermined potential depending on the ambient humidity and the type of the toner. In a state in which the dark portion potential Vd at a solid black portion on the photosensitive drum 1 and the DC voltage Vdc of the power source D3 are fixed, the light portion potential V1 at the solid white portion is adjusted by the exposure intensity. An exposure intensity capable of ensuring a latent image constant obtained by the sum of a certain fog-removing voltage Vback and the developing contrast Vcont corresponding to the charge amount of the toner is set. The exposure intensity is set to cancel the developing contrast Vcont by depositing the toner, on the electrostatic latent image with the dark portion potential Vd, in an amount capable of reproducing an image density at a predetermined level.

The control portion 110 effects setting of the driving voltage of the laser light source 3*a* subsequent to the setting of the temporary constant voltage.

The control portion 110, as an example of third control, detects a current through the current detecting circuit A1 by controlling the power source D1 so as to continuously output the temporary constant voltage to the primary transfer roller 15 even when the surface potential is detected by changing the exposure intensity. Then, the control portion 110 corrects the original temporary constant voltage by using voltage-current data obtained by the above detection to set, as an example of a final constant voltage, an actual constant voltage to be applied to the primary transfer roller 15 during the primary transfer of the toner image.

As a result, accuracy of control of a current passing through the primary transfer portion T1 during the primary transfer of the toner image can be enhanced without decreasing an increment of the voltage to be applied to the primary transfer roller 15 and increasing the number of the applied voltages.

As shown in FIG. 5 with reference to FIG. 3, the control portion 110 starts pre-rotation of the photosensitive drum 1 and the intermediary transfer belt 9 when it receives an image forming signal (S11). This embodiment is an example in which a transfer value is set before image formation. Incidentally, there is no problem even when a step of setting the transfer voltage value is not performed every time before the image formation.

Then, the control portion 110 reads various settings applied during preceding image formation from a storing device 109 and electrically charges the surface of the photosensitive drum 1 to a solid white potential (S12). This is because when the potential is not the solid white potential, a toner image is formed on the photosensitive drum 1 and primary-transferred onto the intermediary transfer belt 9, so that the toner is unnecessarily consumed and deposited on respective portions through which the toner image passes.

Then, the control portion 110 changes a voltage to be applied to the primary transfer roller 15 into three levels and at three levels, detects current values by the current detecting circuit A1 (S13).

Then, the control portion 110 sets a temporary (first voltage value) by using the three applied voltages and the three detected current values to apply the temporary constant voltage to the primary transfer roller 15 (S14).

Then, the control portion 110 changes an output of the laser light source 3*a* at three levels and detects surface potentials at the three levels, respectively, by the potential sensor 22 (S15). At the same time, at the respective light portion potentials V1, current values are detected by the current detecting circuit A1 (S15).

Then, the control portion 110 sets a driving voltage of the laser light source 3*a* during image formation by using the three levels of the exposure intensity and the detected three levels of the latent image contrast (S16).

Then, the control portion 110 sets a constant voltage to be applied from the power source D1 to the primary transfer roller 15 during the primary transfer of the toner image by correcting a first voltage value by the use of voltage-current data obtained through the measurement of the surface potential (S17).

Thereafter, image formation is repeated (S18) until the job is completed (YES of S19).

Embodiment 1

Figure 6:
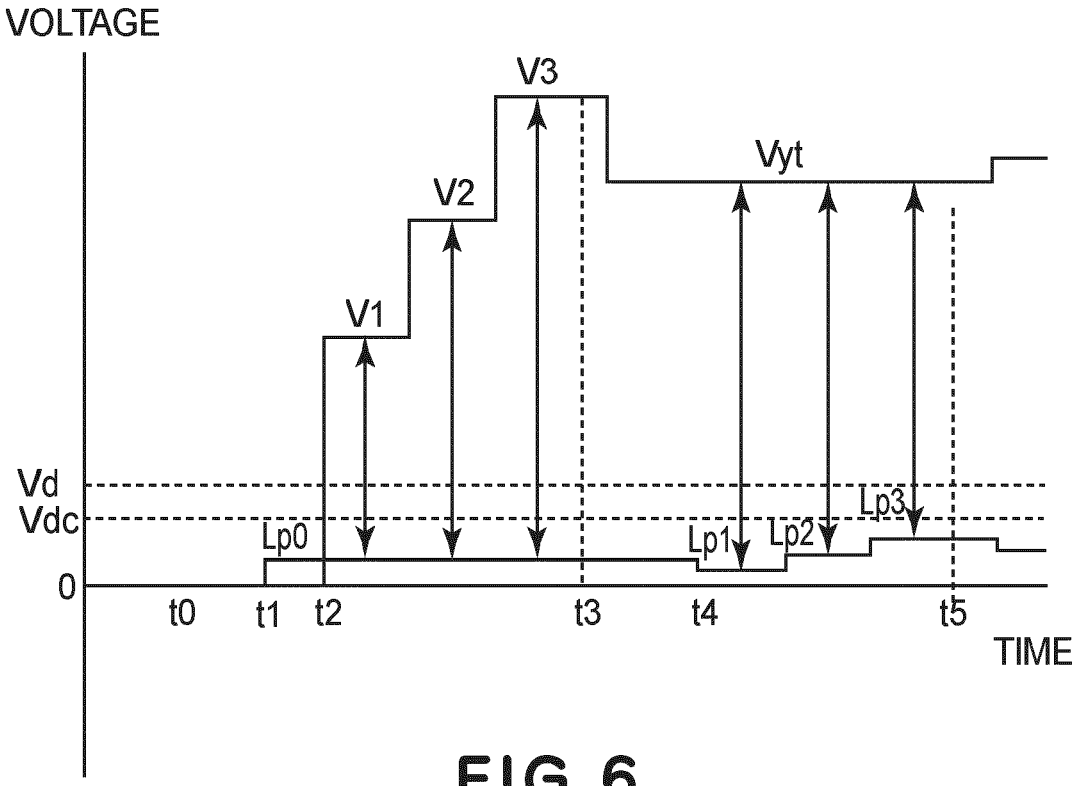
FIG. 6 is a time chart of application of various voltages in Embodiment 1.
Figure 7:
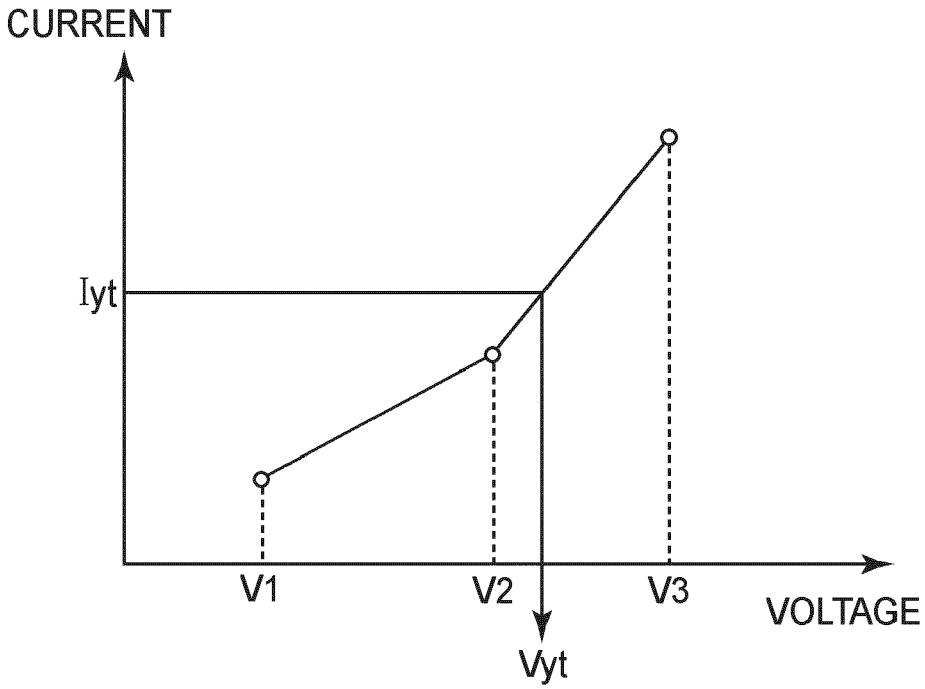
FIG. 7 is a graph for illustrating setting of a temporary constant voltage to be applied to a primary transfer roller.
Figure 8:
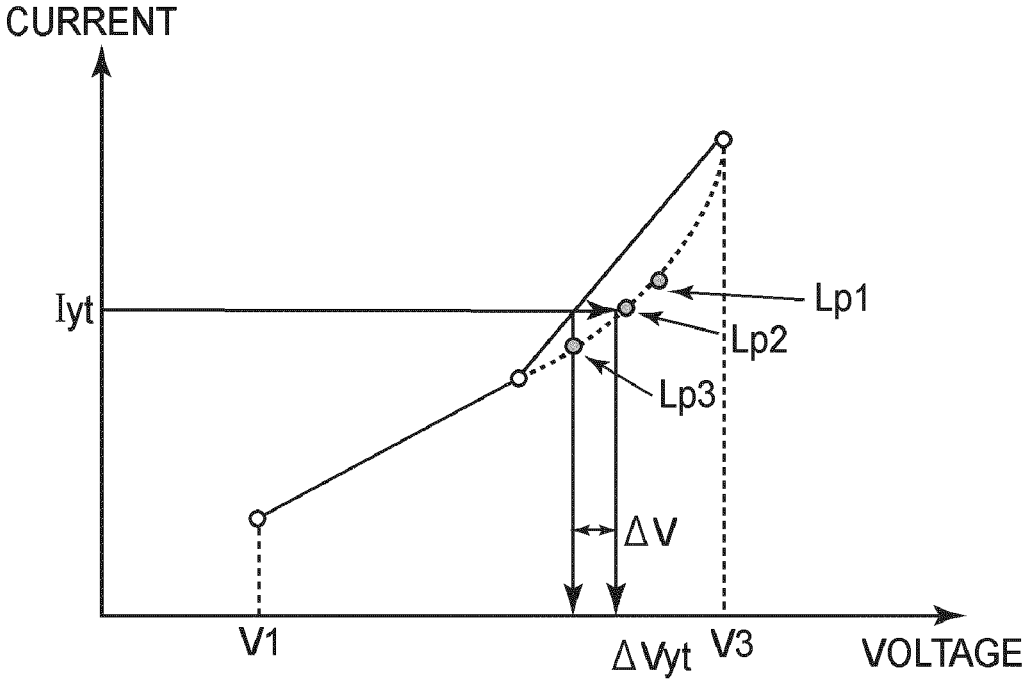
FIG. 8 is a graph for illustrating voltage-current data obtained through measurement of potentials of an electrostatic latent image.
Figure 9:
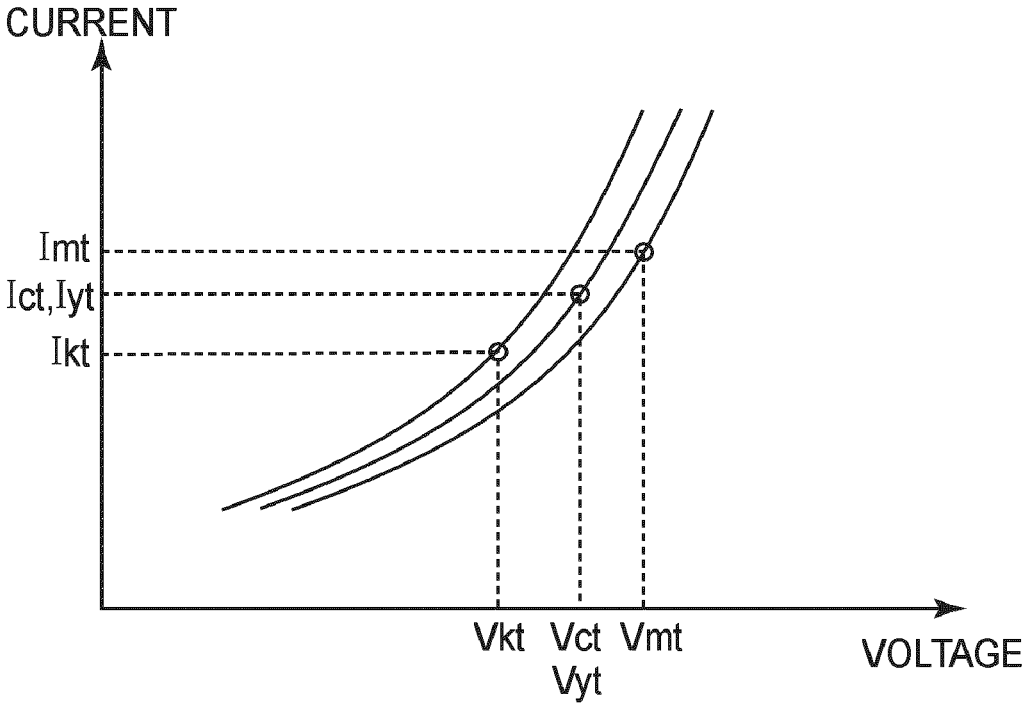
FIG. 9 is a graph for illustrating constant voltages for respective color toner images.

FIG. 6 is a time chart of application of various voltages in Embodiment 1, FIG. 7 is a graph for illustrating setting of a temporary constant voltage to be applied to the primary transfer roller, FIG. 8 is a graph for illustrating voltage-current data obtained through measurement of potentials of electrostatic latent images, and FIG. 9 is a graph for illustrating constant voltages for respective color toner images.

Embodiment 1 as an example of control in the First Embodiment will now be specifically described. With respect to second to fourth toner images, a procedure of a first color (yellow) toner image is similarly repeated. Therefore, in the following, settings of a toner image forming condition and a primary transfer condition with respect to the first color (yellow) toner image will be described in detail.

As shown in FIG. 6 with reference to FIG. 3, prerotation of the photosensitive drum 1 is started at time t0 and formation of a solid white image for yellow is started at time t1. The control portion 110 controls the charging device 2, the exposure device 3 and the power source D3 on the basis of preceding values of a charge voltage, an exposure intensity, and a developing voltage read from the storing device 109. As a result, an electrostatic latent image corresponding to the solid white image for yellow is formed on the photosensitive drum 1 (in this case, the surface of the photosensitive drum 1 is only electrically charged to a solid white potential and transfer onto the recording material is not performed), thus avoiding unnecessary deposition of the yellow toner on the intermediary transfer belt 9 or the like.

Then, from time t2 to time t3, voltages V1, V2 and V3 are successively applied to the primary transfer roller 15 to detect currents, passing through the primary transfer portion T1, in correspondence with potential differences indicated by bidirectional arrows (contrasts between the applied voltages and the solid white image potential) by the current detecting circuit A1.

In this case, the voltage is changed every rotation of the photosensitive drum 1 and the current value is detected at 10 points every 1/10 circumferential length of the primary transfer roller 15. This is because a setting error of the constant voltage due to variation of a resistance value in a (one) circumferential length of the primary transfer roller 15 is decreased.

Further, in order that the constant voltage can be always set in a range from V1 to V3, a large increment of the voltages V1, V2 and V3 is set between 500-1000 V. This is because when the increment is small, a fluctuation in resistance of the primary transfer roller 15 is large, so that a constant voltage for providing a proper current is not readily estimated. In this embodiment, the voltages V1, V2 and V3 are set to V1=1500 V, V2=2000 V and V3=2500 V.

As shown in FIG. 7, by interpolation of voltage (constant voltage between the applied voltage and the solid white image potential)—current data for the voltages V1, V2 and V3, a temporary constant voltage Vyt corresponding to a proper current Iyt for the yellow toner image is obtained. The proper current Iyt is selected from a data table prepared in advance in the storing device 109 of the control portion 110 by making reference to the data table based on the type of the toner and an ambient humidity.

At this time, it is important that the temporary constant voltage Vyt corresponding to the proper current Iyt is set within the range of the three voltages (within the interpolation range). This is because the setting error of the temporary constant voltage Vyt is noticeable when the temporary constant voltage Vyt is in an extrapolation area of the three voltage-current data.

As shown in FIG. 6 with reference to FIG. 3, in a period from subsequent time t4 to time t5, an exposure amount is changed at three levels in a state in which the temporary constant voltage is applied to the primary transfer roller 15 and the light portion potential V1 is detected by the potential sensor 22 at the three levels of the exposure amount. Also in this case, a length of an equipotential surface passing through the primary transfer portion T1 is uniformly controlled similarly as in the case of the constant voltage setting by switching the exposure amount every rotation of the photosensitive drum 1.

In Embodiment 1, the dark portion potential Vd of the surface of the photosensitive drum 1 electrically charged by the charging device 2 was fixed at +500 V, a target value of the developing contrast Vcont since in FIG. 4 was 200 V, and a target value of the fog-removing voltage Vback shown in FIG. 4 was 150 V.

In this case, the latent image contrast as a potential difference between the light portion potential V1 of the solid white portion and the dark portion potential Vd of the solid black portion is 200 V+150 V=350 V. The light portion potential V1 of the solid white portion is 500 V−350 V=150 V. The DC voltage Vdc of the developing voltage to be applied to the developing sleeve S8 of the yellow developing device 8Y is set to 150 V+200 V=350 V.

The control portion 110 sets exposure outputs Lp1, Lp2 and Lp3 of the laser light source 3*a* so that target values of the light portion potential V1 with respect to the constant dark portion potential Vd=500 V are V11=+100 V, V12=+150 V, and V13=+200 V.

Setting values of the driving voltage of the laser light source 3*a* corresponding to the exposure outputs Lp1, Lp2 and Lp3 are selected from the data table prepared in advance in the storing device 109 by making reference to the data table based on an ambient humidity and the type of the toner.

The control portion 110 subsequently forms solid white images for yellow actually at three levels (Lp1, Lp2 and Lp3) of the exposure output and actually measures surface potentials by the potential sensor 22. The control portion 110 obtains an exposure output at which the actually measured value is the light portion potential V1=+150 V by interpolation of the thus-obtained relationship between the three levels of the exposure output and the actually measured surface potential values. The driving voltage of the laser light source 3*a* at which the actually measured value is the light portion potential V1=+150 V is set as the driving voltage of the laser light source 3*a*.

Further, at the same time, in the period from time t4 to time t5, a voltage-current data at the primary transfer portion T1 is obtained by utilizing the light portion potential V1 surface which has already been subjected to the potential detection by the potential sensor 22.

The surfaces of the light portion potentials V11, V12 and V13 exposed at the exposure outputs Lp1, Lp2 and Lp3, respectively, pass through the primary transfer portion T1, in this order, at which the temporary Vyt is applied to the primary transfer roller 15. At these times, currents passing through the primary transfer portion T1 depending on potential differences indicated by biodirectional arrows (contrasts between the applied voltage and solid white image potentials) are detected by the current detecting circuit A1.

The control portion 110 detects the current values by the current detecting circuit A1 at 10 points every 1/10 circumferential length of the primary transfer 15 contacting the light portion potential V1 surface and an average of the detected current values is used as a current value at the light portion potential V1. Similarly, current values at the light portion potentials V12 and V13. As a result, a voltage (contrast between the applied voltage and the solid white image potential)-current data with respect to three voltages with an increment smaller than that of the voltages V1, V2 and V3 is newly added.

In this embodiment, it is assumed that the actually measured potential values of the surfaces exposed at the exposure outputs Lp1, Lp2 and Lp3 are V11=100 V, V12=150 V and V13=200 V, respectively. When the actually measured value of the light portion potential V1 at the time of setting a temporary constant voltage ΔVyt is 130 V, the contrast values between the applied voltage and the solid white image potentials are added, as ΔVyt=+30 V, ΔVyt=−20 V, and ΔVyt=−70 V, respectively, into the voltage-current data shown in FIG. 7 including the three voltages.

As shown in FIG. 8 with reference to FIG. 7, the newly added data relating to the three exposure outputs (Lp1, Lp2 and Lp3) are plotted in a blank area between the voltage V2 and the voltage V3 and more strictly represents the voltage-current relationship in the neighborhood of the temporary constant voltage Vyt.

Then, a new constant voltage ΔVyt corresponding to the proper current Iyt for the yellow toner image is obtained by interpolation of the three voltage-current data obtained at the exposure outputs Lp1, Lp2 and Lp3.

However, thereafter, when the above-described output setting of the laser light source 3*a* is carried out, the light portion potential V1 is different from that at the time of setting the temporary constant voltage Vyt. For this reason, it is necessary that an X axis (abscissa) of the graph shown in FIG. 8 is shifted by a difference in light portion potential V1 between before and after the output adjustment of the laser light source 3*a* to correct the temporary constant voltage Vyt and the new constant voltage ΔVyt (FIG. 6).

The new constant voltage ΔVyt is corrected by the following equation:

Corrected value of $\Delta Vyt$=(solid white light portion potential $V1$ after output setting of laser light source $3a$)−(solid white light portion potential $V1$ at the time of setting a temporary constant voltage $Vyt$)+new constant voltage $\Delta Vyt$.

For example, in Embodiment 1, it is assumed that the actually measured value of the solid white light portion potential V1 after the output setting of the laser light source 3*a* is +150 V, the actually measured value of the solid white light portion potential V1 at the time of setting the temporary constant voltage Vyt is +130 V, and the new constant voltage ΔVyt obtained from FIG. 8 is 2130 V. In this case, the corrected value of ΔVyt, i.e., 150×130+2130=2150 (V) is set to be applied to the primary transfer roller 15.

The constant voltage setting and the exposure output setting of the laser light source 3*a* as described above are similarly repeated also with respect to the remaining color toner images of magenta, cyan and black.

The toners of yellow, magenta, cyan and black provide different charge amounts and different image densities, so that developing contrasts Vcont for realizing the same image density are also different from each other. As a result, amounts per unit area of the toner images of yellow, magenta, cyan and black formed on the photosensitive drum 1 are also different from each other.

As shown in FIG. 9, depending on the different amounts per unit area of the toners, proper currents Iyt, Imt, Ict and Ikt vary, respectively, so that constant voltages ΔVyt, ΔVmt, ΔVct and ΔVkt are also different. By employing such a constitution, even when the resistance of the primary transfer roller 15 fluctuates by accumulation of the ambient humidity and the operating time or even when the proper light portion potentials V1 for the respective color toners are different, it is possible to primary-transfer the respective color toner images with high transfer efficiency.

Comparative Embodiment 1

Figure 10:
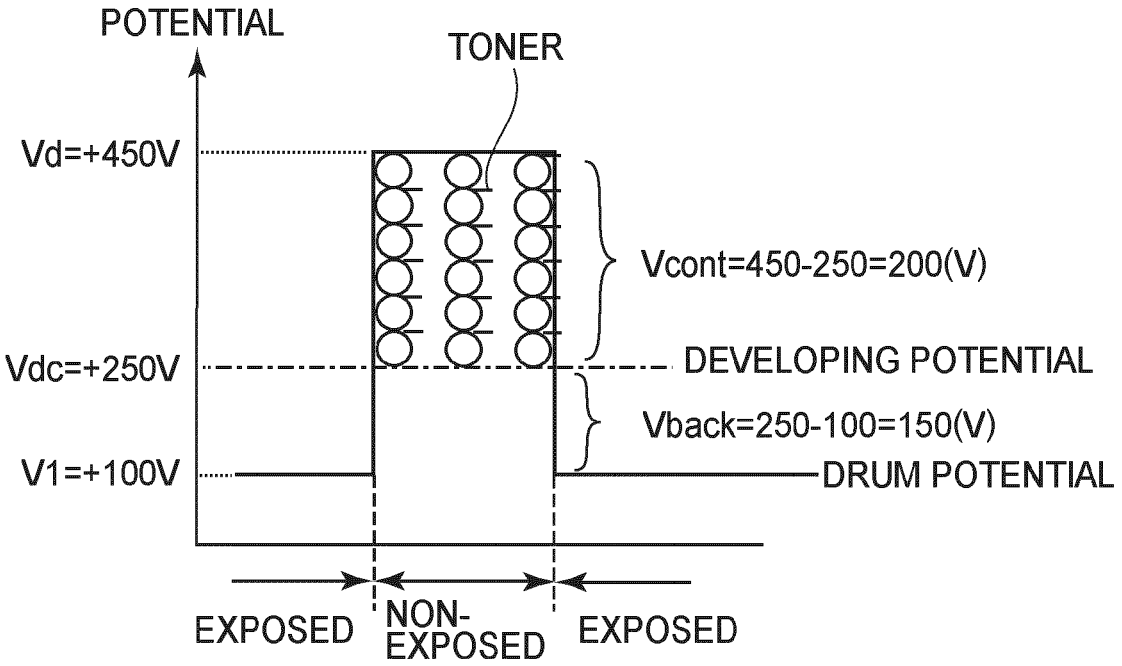
FIG. 10 is a schematic diagram for illustrating the case of a light portion potential of 100 V in Comparative Embodiment 1.
Figure 11:
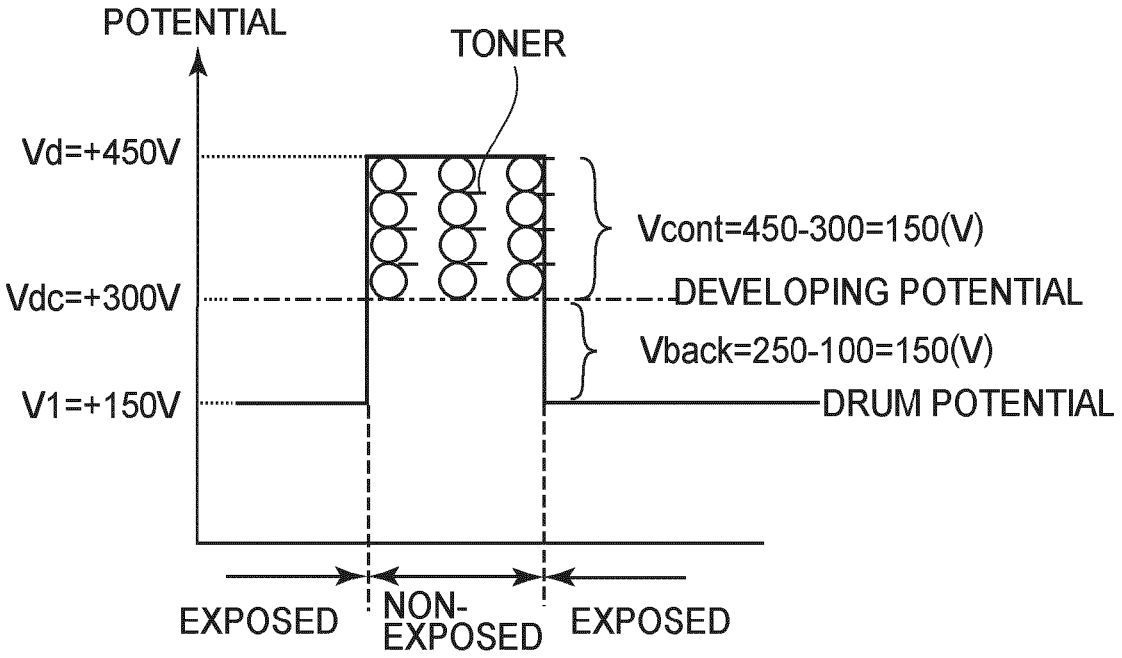
FIG. 11 is a schematic diagram for illustrating control for changing the light portion potential to 150 V.
Figure 12:
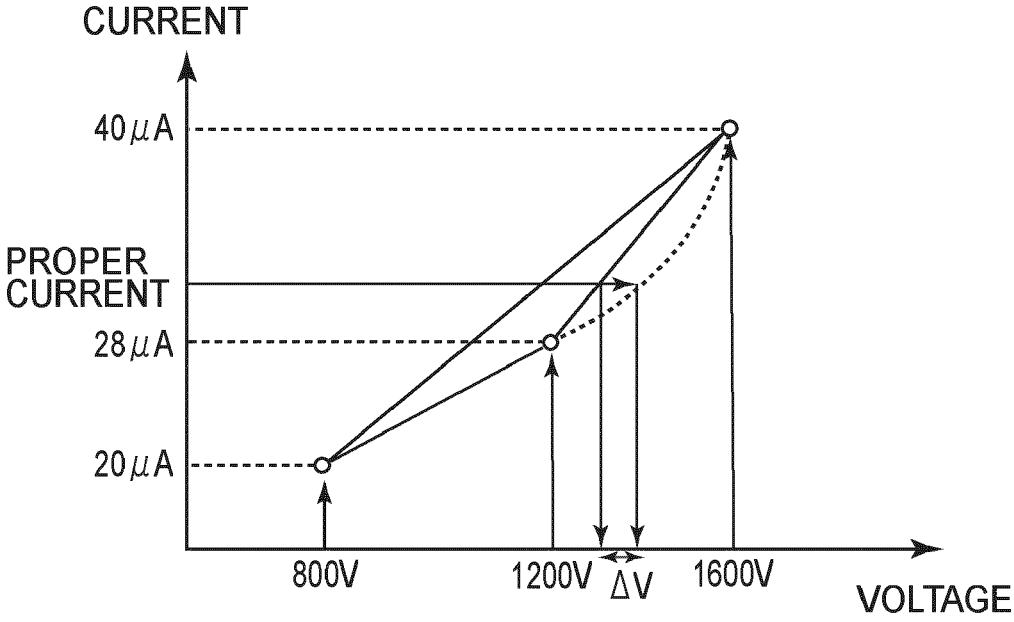
FIG. 12 is a graph for illustrating the case of setting a constant voltage by three voltage-current data.
Figure 13:
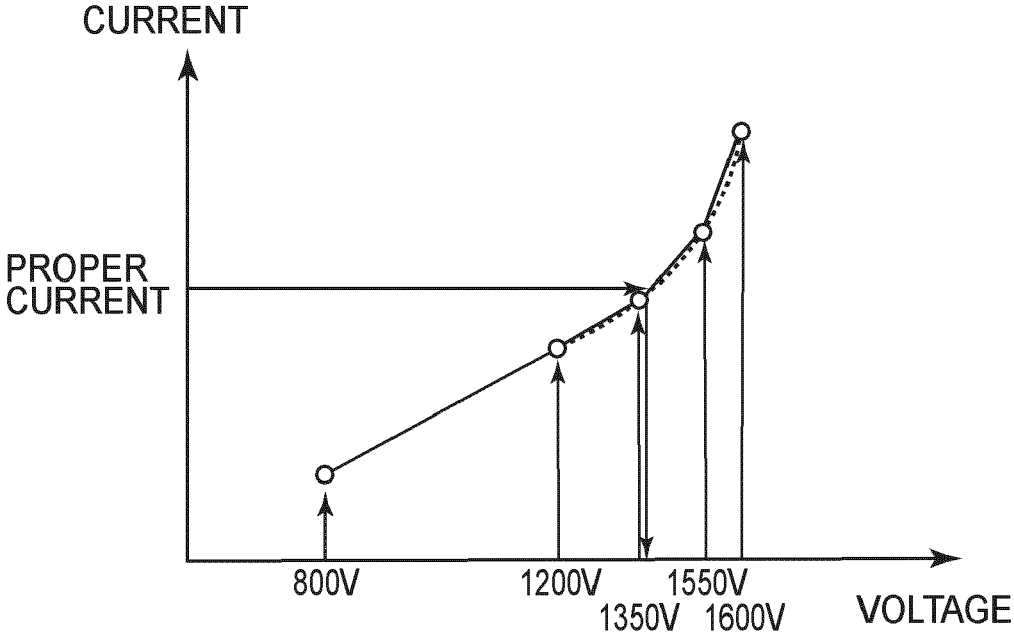
FIG. 13 is a graph for illustrating the case of setting a constant voltage by four voltage-current data.

FIG. 10 is a schematic diagram for illustrating the case of a light portion potential of 100 V in Comparative Embodiment 1, FIG. 11 is a schematic diagram for illustrating control for changing the light portion potential to 150 V, FIG. 12 is a graph for illustrating the case of setting a constant voltage by three voltage-current data, and FIG. 13 is a graph for illustrating the case of setting a constant voltage by four voltage-current data.

In Comparative Embodiment 1, in contrast to Embodiment 1, after the toner image forming condition including the exposure output of the laser light source is set in a general way, the primary transfer condition of the toner image (the constant voltage to be applied to the primary transfer roller) is independently set. Comparative Embodiment 1 has the same mechanical constitution of the image forming apparatus except for a difference in control, thus being described with reference to FIG. 3.

As shown in FIG. 3, in the storing device 109 of the control portion 110, a proper developing contrast Vcont data for each of combinations of ambient humidities and the respective color toners is stored in advance.

The control portion 110 selects the developing contrast Vcont by making reference to the developing contrast Vcont data storing in the storing device 109 based on the ambient humidity and the color of the toner in advance to the setting of the toner image forming condition.

When the pre-rotation is started, the control portion 110 controls the power source D4 so that the potential detection result by the potential sensor 22 is a predetermined light portion potential Vd in a state in which the laser light source 3*a* is actuated at an exposure output for providing a solid white light portion potential with reliability, thus electrically charging the photosensitive drum 1.

Then, a light portion potential V1 for realizing the developing contrast Vcont is set by adjusting the exposure intensity of the laser light source 3*a*. As an example, the case where a light portion potential V1 for carrying out development with the yellow toner is +150 V will be described.

As shown in FIG. 10 with reference to FIG. 3, the surface of the photosensitive drum 1 is electrically charged to a solid black dark portion potential Vd=+450 V at which the yellow toner image is formed by development, by the charging device 2. In an area in which the yellow toner image is not formed by development, the surface of the photosensitive drum 1 is electrically discharged to a solid white light portion potential V1=+100 V by the exposure device 3. Further, the power source D3 applies a developing voltage in the form of a DC voltage Vdc=+250 V biased with an AC voltage.

Next, the light portion potential V1 is changed by adjusting the exposure output of the laser light source 3*a* by an amount of adjustment of the developing contrast Vcont. At this time, the fog-removing voltage Vback is kept at a constant level by changing the DC voltage Vdc by an amount of the change in light portion potential V1. As an example, a DC Vcont of 200 V is adjusted to 150 V will be described.

As shown in FIG. 11 with reference to FIG. 3, the driving voltage of the laser light source 3*a* is decreased until the solid white light portion potential V1 detected by the potential sensor 22 reaches 150 V while the dark portion potential Vd is kept at +450 V, thus lowering the exposure output.

Thereafter, the DC voltage Vdc is increased by 50 V to +300 V, so that the developing contrast Vcont is adjusted from 200 V to 150 V while the fog-removing voltage Vback is kept at 150 V.

As another method, similarly as in Embodiment 1, the exposure intensity of the laser light source 3*a* is changed at a plurality of preset levels and at each of the levels, the surface potential of the photosensitive drum 1 is detected by the potential sensor 22. As a result, for example, solid white images with four potential levels changed from about +100 to about 200 V with an increment of 50 V. From the relationship between the driving voltage of the laser light source 3*a* and the actually measured potential value at each of the levels, a driving voltage at which the solid white light portion potential V1 detected by the potential sensor 22 corresponds to 150 V is obtained and set for the laser light source 3*a*.

In any event, when the setting of the dark portion potential Vd and the light portion potential V1 is completed, the control portion 110 starts the setting of the constant voltage to be applied to the primary transfer roller 15. In a state in which the solid white image is formed at the set light portion potential V1=150 V, constant voltage-controlled voltages of 800 V, 1200 V and 1600 V are applied from the power source D1 to the primary transfer roller 15.

Similarly as in Embodiment 1, a current at each of the voltages is obtained by detecting currents through the current detecting circuit A1 at 10 points in one circumferential length of the primary transfer roller 15 while the same voltage is continuously applied to the primary transfer roller 15 during one rotation of the photosensitive drum 1 and averaging the detected values.

As shown in FIG. 12, the control portion 110 obtains the relationship between the voltage to be applied to the primary transfer roller 15 and the current passing through the primary transfer portion T1 and then sets a voltage of 1400 V corresponding to a proper current of 35 μA as the constant voltage.

Similarly, after the exposure output or the like of the laser light source 3*a* at the time of forming the magenta toner image, a constant voltage to be applied to the primary transfer roller 15 at the time of primary-transferring the magenta toner image is set. However, as described above, a proper current is different from those in the case of other color toner images, so that the constant voltage is also different from those in the case of other color toner images.

Similarly, after the exposure output or the like of the laser light source 3*a* at the time of forming the cyan toner image, a constant voltage to be applied to the primary transfer roller 15 at the time of primary-transferring the cyan toner image is set. However, as described above, a proper current is different from those in the case of other color toner images, so that the constant voltage is also different from those in the case of other color toner images.

Similarly, after the exposure output or the like of the laser light source 3*a* at the time of forming the black toner image, a constant voltage to be applied to the primary transfer roller 15 at the time of primary-transferring the black toner image is set. However, as described above, a proper current is different from those in the case of other color toner images, so that the constant voltage is also different from those in the case of other color toner images.

When settings of the four types of the toner image forming conditions and the four types of the constant voltages are completed through the above-described control, the procedure is changed from the pre-rotation to image formation, in which toner image formation and primary transfer for the image formation are carried out.

In Comparative Embodiment 1, as shown in FIG. 12, the three voltage-current data for the voltages of 800 V, 1200 V and 1600 V are used, so that it is possible to set the constant voltage at which a current closer to the proper current of 25 μA than that of the case of using two voltage-current data for the voltages of 800 V and 1600 V.

However, compared with the voltage-current relationship indicated by a broken line, the three voltage-current data for the voltages of 800 V, 1200 V and 1600 V causes an error ΔV.

As shown in FIG. 13, if two voltage-current data for voltages of 1350 V and 1450 V between the voltage of 1200 V and the voltage of 1600 V can be obtained, it is possible to eliminate the error shown in FIG. 12 by precisely following the voltage-current relationship indicated by the broken line.

However, in Comparative Embodiment 1, when one rotation of the photosensitive drum 1 is kept for one level of the voltage, it is necessary to add two pre-rotations for yellow (one color), i.e., eight pre-rotations for four colors in total. For this reason, a time from the start of the pre-rotation until actual image formation is started in excessively increased, so that productivity of the image forming apparatus 100 is not improved.

In contrast to Comparative Embodiment 1, in Embodiment 1, in advance of the setting of the toner image forming condition, the temporary constant voltage is set and is then corrected by using the voltage-current data obtained in association with the setting of the toner image forming condition. For this reason, without increasing the number of pre-rotations associated with the setting of the constant voltage, it is possible to effect accurate constant voltage setting comparable to the case of obtaining the voltage-current data from the voltages 1350 V and 1450 V shown in FIG. 13.

In Embodiment 1, simultaneously with the adjustment of the developing contrast Vcont, the adjustment of the constant voltage to be applied to the primary transfer roller 15 is performed, so that it is possible to set the constant voltage with high accuracy without lowering the productivity of the image forming apparatus 100. Instead of the constant voltage obtained from the three voltage-current data shown in FIG. 7, the constant voltage can be obtained from the six voltage-current data shown in FIG. 8.

Further, the voltage-current data including the different light portion potentials V1 is obtained by using the temporary constant voltage Vyt set by detecting the current with the large increment from 500 V to 1000 V, so that it is possible to ensure additional voltage-current data in the neighborhood of that for the temporary constant voltage Vyt. After rough estimation of the constant voltage with respect to the proper current Iyt with the large increment from 500 V to 1000 V, fine adjustment of the constant voltage is performed on the basis of a small voltage difference in association with the adjustment of the developing contrast Vcont.

As shown in FIG. 8, when the constant voltage corresponding to the proper current Iyt is obtained by simply performing the interpolation of the voltage-current data for the voltages V2 and V3, an error ΔV occurs when compared with the proper constant voltage-current curve indicated by a dotted line.

On the other hand, in Embodiment 1, with respect to the temporary constant voltage Vyt, the light portion potential V1 is changed finely at the exposure outputs Lp1, Lp2 and Lp3 to obtain the voltage-current data for the primary transfer portion T1, so that it is possible to set the constant voltage more precisely. As a result, it is possible to effect high-quality image formation with a high transfer efficiency and less transfer failure.

The setting of the constant voltage to be applied to the primary transfer roller 15 is performed simultaneously with the developing contrast Vcont setting, so that high-accuracy constant voltage can be set with no lowering in productivity of the image forming apparatus 100.

The constant voltage with respect to the proper current Iyt is roughly estimated by using the three voltage-current data obtained by applying the voltage at three levels to the primary transfer roller 15 and the voltage-current data with the small increment is utilized as an interpolated data during the adjustment of the developing contrast Vcont. For this reason, it is possible to finely adjust the constant voltage. The increment of the surface potential used at the time of setting a forming condition of a contrast potential control electrostatic latent image is smaller than that of the voltage used at the time of setting the constant voltage to be applied to the transfer member, so that the obtained voltage-current data is capable of performing interpolated computation with high accuracy.

Therefore, it is possible to enhance setting accuracy of the transfer constant voltage by interpolation with the detailed voltage-current data in the neighborhood of the roughly set constant voltage. The voltage-current data is obtained as a by-product at the time of setting the electrostatic latent image forming condition, so that it is not necessary to obtain the voltage-current data by changing the voltage to be applied to the transfer member in the neighborhood of the constant voltage.

Second Embodiment

Figure 14:
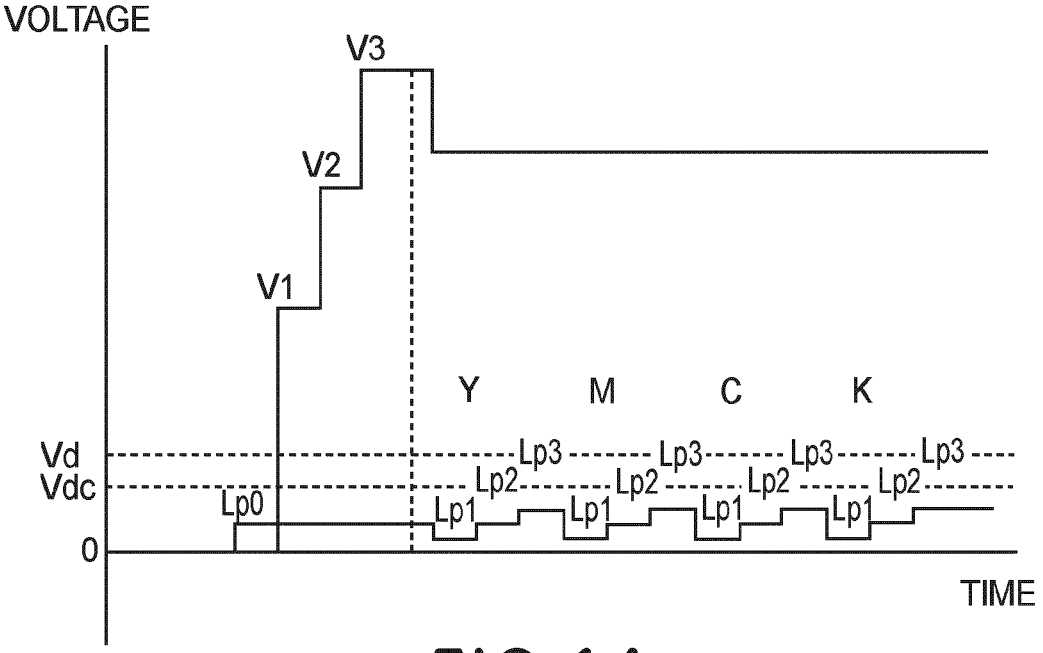
FIG. 14 is a time chart for illustrating setting of a constant voltage in an image forming apparatus in a Second Embodiment.
Figure 15:
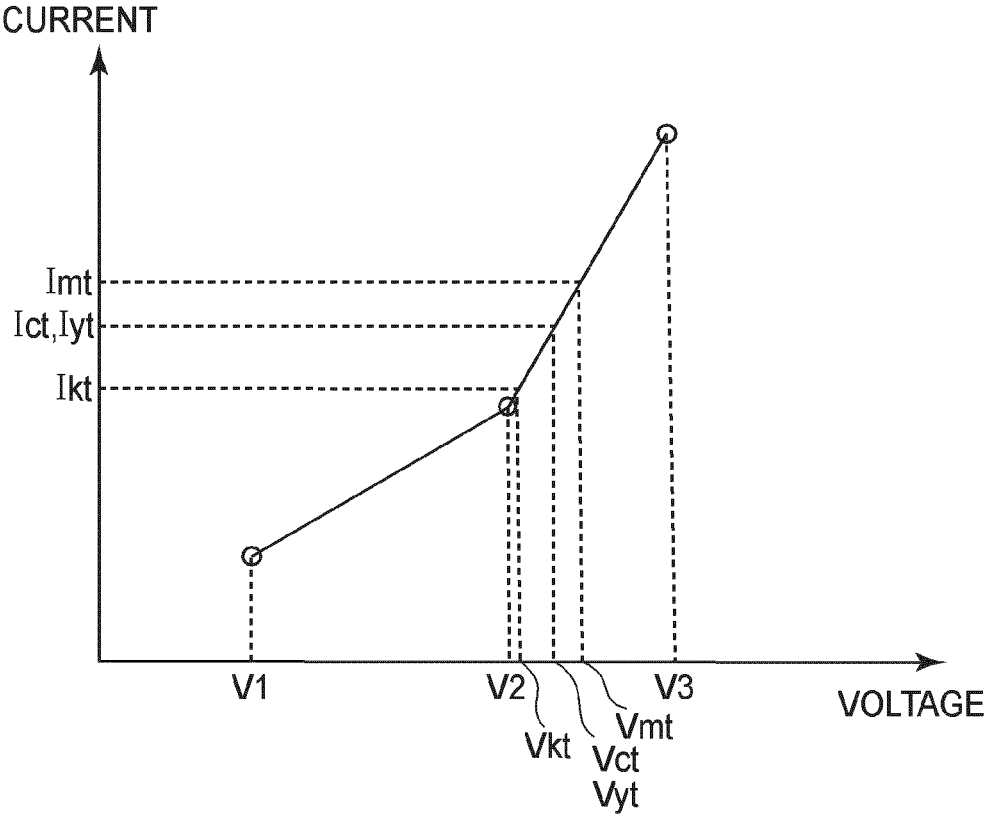
FIG. 15 is a graph for illustrating setting of a temporary constant voltages with respect to respective color toners.

FIG. 14 is a time chart of setting of a constant voltage in an image forming apparatus of a Second Embodiment, and FIG. 15 is a graph for illustrating setting of this embodiment constant voltages for respective color toners. A mechanical constitution of Second Embodiment is the same as in the First Embodiment except for a difference in control, so that temporary will be described with reference to FIGS. 3-9.

As shown in FIG. 6 with reference to FIG. 3, in the First Embodiment, the settings of the temporary constant voltage Vyt and the toner image forming condition and the correction of the temporary constant voltage Vyt were carried out for each of the color toners. That is the control for measuring the current at each of the three levels of voltages applied to the primary transfer roller 15 was repeated four times.

On the other hand, in this embodiment, after the control for measuring the current at each of the three levels of voltages applied to the primary transfer 15 is performed one time, setting of individual toner image forming condition and correction of the temporary constant voltage Vyt are repeated four times. As a result, the number of re-rotation of the photosensitive drum 1 can be reduced by (three color)×(three rotations)=nine rotations in total.

As shown in FIG. 14 with reference to FIG. 3, in this embodiment, the control portion 110 stepwisely changes the voltage, to be applied from the power source D1 to the primary transfer roller 15, every one rotation of the photosensitive drum 1. Then, at each of the voltages, the current passing through the primary transfer portion T1 is detected by the current detecting circuit A1 and three voltage-current data are interpolated to set a temporary constant voltage Vyt corresponding to the proper current.

Then, in a state in which the temporary constant voltage Vyt is applied to the primary transfer roller 15, an exposure intensity of the laser light source 3*a* during yellow toner image formation is set.

The control portion 110, as an example of second control, stepwisely changes the exposure intensity of the laser light source 3*a* every one rotation of the photosensitive drum 1 and measures the surface potential of the photosensitive drum 1 at each exposure intensity through the potential sensor 22. Then, the control portion 110 sets the driving voltage of the laser light source 3*a* during the yellow toner image formation by using the three exposure intensity-surface potential measured data so as to ensure a predetermined developing contrast depending on the type of the toner and the ambient humidity.

Further, the control portion 110, as an example of third control, measures a value of a current passing through the primary transfer portion T1 in correspondence with the surface potential at each exposure intensity to obtain three voltage-current data with a small increment in the neighborhood of the temporary constant voltage Vyt.

As shown in FIG. 8, the temporary constant voltage Vyt is corrected by using the new three voltage-current data, so that a constant voltage for providing a proper current passing through the primary transfer portion T1 during the primary transfer of the yellow toner image.

As shown in FIG. 15, the control portion 110 also calculates temporary constant voltages Vmt, Vct and Vkt corresponding to different proper currents for magenta (Imt), cyan (Ict) and black (Ikt), respectively, by using the same three voltage-current data. As a result, the three voltage-current data obtained in association with the setting of exposure intensity of the laser light source 3*a* for magenta, cyan and black are substantially distributed at a constant level with respect to the temporary constant voltages Vmt, Vct and Vkt.

In a state in which the temporary constant voltage Vmt is applied to the primary transfer roller 15, similarly as in the case of the yellow toner image, the exposure intensity of the laser light source 3*a* during the magenta toner image formation is set. Then, new three voltage-current data obtained in associated with the exposure intensity setting is used to correct the temporary constant voltage Vmt, so that a constant voltage for providing the proper current passing through the primary transfer portion T1 during the primary transfer of the magenta toner image.

Similar processing and settings are repeated with respect to the cyan toner and the black toner, so that the exposure intensity of the laser light source 3*a* and the constant voltage to be applied to the primary transfer roller 15 which are optimized for each of the colors are set.

That is, in the Second Embodiment, a plurality of developing means each capable of developing an electrostatic latent image formed on a common image bearing member is provided and control of electrostatic latent image setting adapted to individual developing means is carried out in succession to control for setting a common temporary constant voltage. Then, an individual final constant voltage corrected on the basis of a current measurement result during individual electrostatic latent image setting is applied to the transfer member during toner of each of the toner images.

Third Embodiment

In the First and Second Embodiments, the embodiment in which the regular developing method wherein the toner image is deposited on the non-exposed portion of the electrostatic latent image is employed is described. However, also in an image forming apparatus of temporary employing a reverse developing method in which the toner image is deposited on the exposed portion of the electrostatic latent image, similarly as in the First and Second Embodiments, it is possible to obtain voltage-current data with a small increment at the transfer portion during setting of the charging voltage and exposure output after the temporary constant voltage is set. As a result, it is possible to enhance setting accuracy of the constant voltage to be applied to the transfer member without increasing the number of pre-rotation of the photosensitive drum 1.

That is, even in the case of the reverse developing method employed in this embodiment, effects similar to those in the First and Second Embodiments are achieved when the non-exposed portion potential as the solid white portion potential is adjusted by changing the photosensitive drum charge amount at the time of adjusting the image density.

As described above several embodiments of the present invention are described. However, the image forming apparatus according to the present invention is also applicable to other embodiments in which a part or all of the constitutions of the above-described embodiments are alternative constitutions so long as contrast potential control can be executed in a state in which a constant voltage is applied to the transfer member.

Accordingly, the present invention is also applicable to a tandem-type image forming apparatus in which a plurality of image bearing members is disposed along a recording material conveying member or an intermediary transfer member, a single-color image forming apparatus in which a toner image is directly transferred onto a recording material, and so on.

In the above-described embodiments, only a principal portion of the image forming apparatus associated with toner image formation and transfer is described but the present invention is applicable to various fields of image forming apparatuses such as printers, various printing machines, copying machines, facsimile machines, and multi-purpose machines by adding necessary equipment, options, and casing structures.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 207489/2007 filed Aug. 9, 2007, which is hereby incorporated by reference.

What is claimed is:

1. An image forming apparatus comprising:

an image bearing member;

a toner image forming device for forming a toner image on said image bearing member;

a transfer member for forming a transfer portion for transferring the toner image formed on said image bearing member onto a transfer material in a state in which the transfer portion is pressed to said image bearing member;

a power source for applying a voltage to said transfer member;

a current detecting portion for detecting a current passing through said transfer member by the application of the voltage to said transfer member;

a first control portion for executing a first step of setting a first voltage value to be applied to said transfer member depending on an output of said current detecting portion;

a potential detecting member for detecting a potential of said image bearing member;

an adjusting portion for adjusting a toner image forming condition on the basis of a detected potential, by said potential detecting member, of an electrostatic latent image formed for adjusting the toner image forming condition; and a second control portion for executing a second step of setting a second voltage value to be applied to said transfer member during image formation on the basis of a current detected by a current detecting portion when the electrostatic latent image passes through the transfer portion in a state in which the voltage of the first voltage value is applied to said transfer member.

2. An apparatus according to claim 1, wherein in the first step, the first voltage value is set by applying power of a plurality of different voltage values to said transfer member in a state in which a potential of said image bearing member is constant.

3. An apparatus according to claim 1, wherein in the second step, the second voltage value to be applied to said transfer member during image formation is determined by detecting current values, passing through said transfer member, corresponding to a plurality of different potentials on said image bearing member in a state in which the voltage of the first voltage value is applied to said transfer member.

4. An apparatus according to claim 2, wherein the first voltage value is within a range of the plurality of different voltage values.

5. An apparatus according to claim 1, wherein said image forming apparatus further comprises a plurality of toner image forming devices for forming toner images by using different color toners, and wherein said second control portion sets a voltage value to be applied to said transfer member during image formation for each of said toner image forming devices.

* * * * *